US009485820B2

(12) United States Patent
Ido et al.

(10) Patent No.: US 9,485,820 B2
(45) Date of Patent: Nov. 1, 2016

(54) LIGHTING DEVICE AND LIGHTING FIXTURE

(71) Applicant: Panasonic Intellectual Property Management Co., Ltd., Osaka (JP)

(72) Inventors: Shigeru Ido, Osaka (JP); Hiroshi Kido, Osaka (JP); Akinori Hiramatu, Nara (JP); Junichi Hasegawa, Osaka (JP); Daisuke Ueda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 49 days.

(21) Appl. No.: 14/639,234

(22) Filed: Mar. 5, 2015

(65) Prior Publication Data

US 2015/0257217 A1 Sep. 10, 2015

(30) Foreign Application Priority Data

Mar. 7, 2014 (JP) ..... 2014-045606

(51) Int. Cl.
*H05B 41/16* (2006.01)
*H05B 33/08* (2006.01)

(52) U.S. Cl.
CPC ..... *H05B 33/0815* (2013.01)

(58) Field of Classification Search
CPC ..... H05B 33/0815; H05B 33/0845; H05B 33/0818; H05B 33/0851; H05B 37/02; H05B 41/2822; H05B 41/3927; H05B 33/0848; H05B 41/2828; H05B 6/6464; H05B 37/0263; H05B 41/2824; H05B 6/6411; H05B 6/687
See application file for complete search history.

(56) References Cited

U.S. PATENT DOCUMENTS

2007/0059016 A1* 3/2007 Sato ..... G03G 15/80 399/88
2011/0084619 A1* 4/2011 Gray ..... H05B 33/0824 315/185 R
2012/0200230 A1 8/2012 Esaki et al.
2012/0262080 A1 10/2012 Watanabe et al.
2012/0262082 A1 10/2012 Esaki et al.
2013/0099691 A1 4/2013 Esaki et al.
2013/0162155 A1* 6/2013 Matsuda ..... H05B 33/0839 315/200 R
2013/0169160 A1* 7/2013 Kim ..... H05B 37/02 315/122

FOREIGN PATENT DOCUMENTS

JP 2012-142216 A 7/2012
JP 2012-204026 A 10/2012

(Continued)

*Primary Examiner* — Monica C King
(74) *Attorney, Agent, or Firm* — Renner, Otto, Boisselle & Sklar, LLP

(57) ABSTRACT

A lighting device includes a power conversion unit, an impedance adjustment unit, a first control unit, and a second control unit. The power conversion unit is configured to convert input power to direct-current power used for a light source. The impedance adjustment unit is formed of a series circuit of a resistor element and a switch element and is coupled to the light source in parallel, relative to the power conversion unit. The second control unit is configured to cause the power conversion unit to operate, for each burst cycle, for an operation period which is not longer than the burst cycle, and increase and reduce the ratio of the operation period to the burst cycle. The first control unit is configured to make the switch element conductive for a predetermined adjustment period which is not longer than the operation period, during the operation period.

16 Claims, 10 Drawing Sheets

(56) References Cited

FOREIGN PATENT DOCUMENTS

| | | | |
|---|---|---|---|
| JP | 2012-226924 | A | 11/2012 |
| JP | 2013-004413 | A | 1/2013 |
| JP | 2013-093116 | A | 5/2013 |
| JP | 2013-196759 | A | 9/2013 |

* cited by examiner

LIGHTING DEVICE AND LIGHTING FIXTURE

CROSS-REFERENCE TO RELATED APPLICATION

This application claims the benefit of priority of Japanese Patent Application Number 2014-045606, filed on Mar. 7, 2014, the entire contents of which are hereby incorporated by reference.

TECHNICAL FIELD

The disclosure relates to lighting devices and lighting fixtures, in general, and particularly relates to a lighting device that turns on a light source formed of a solid light emitting element such as a light emitting diode, and a lighting fixture using the lighting device.

BACKGROUND ART

In recent years, in place of incandescent lamps and fluorescent lamps, solid light emitting elements, such as light emitting diodes and organic electroluminescence (EL) elements, have been widely used as illumination light sources. For example, JP 2012-204026 A (which will be hereinafter referred to as "Document 1") discloses, as a lighting device that turns on a light source formed of a light emitting diode (LED), a lighting device (a solid light source lighting device) that adjusts the light quantity (controls light) of an LED in accordance with a light control signal given from a light controller.

Incidentally, LED light control methods includes a light control method (which will be hereinafter referred to as a "DC light control method") in which the magnitude of an electrical current that continuously flows in an LED is changed. Also, as another light control method, there is a method (which will be hereinafter referred to as a "burst light control method") in which energization of an LED is periodically turns on and off to change the ratio (on-duty ratio) in an energization period, or the like. Furthermore, there are cases where the DC light control method and the burst light control method are combined, as in a related art example described in Document 1.

Incidentally, normally, a switching power supply circuit is used for a lighting circuit that turns on an LED. In the burst light control method, as a light control level reduces, the energization period in which the switching power supply circuit performs switching operation reduces. On the other hand, the number of times (an operation number) the switching power supply circuit performs switching operation in an energization period varies even among a plurality of energization periods having the same length, and the light quantity of a light source fluctuates due to the variation. When an energization period is relatively long, that is, when the brightness indicated by the light control level is relatively high, a fluctuation in light quantity due to a variation in operation number is not recognized by humans and hardly causes a problem.

However, when an energization period is relatively short, that is, when the brightness indicated by the light control level is relatively low, a fluctuation in light quantity due to a variation in operation number is easily recognized as flickers by humans.

SUMMARY OF THE INVENTION

In view of the foregoing, the present technology has been devised, and it is an object of the present to enable light control to a low light control level while reducing flickers.

A lighting device according to an aspect of the present invention includes a power conversion unit, an impedance adjustment unit, a first control unit, and a second control unit. The power conversion unit is configured to convert input power to direct-current power used for a light source formed of a solid light emitting element. The impedance adjustment unit is formed of a series circuit of a resistor element and a switch element and is coupled to the light source in parallel, relative to the power conversion unit. The second control unit is configured to cause the power conversion unit to operate, for each predetermined burst cycle, for an operation period which is not longer than the burst cycle, and increase and reduce the ratio of the operation period to the burst cycle. The first control unit is configured to make the switch element conductive for a predetermined adjustment period which is not longer than the operation period, during the operation period.

A lighting fixture according to another aspect of the present invention includes any one of the above-described lighting devices, and a fixture body that supports the lighting device.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

First Embodiment

A lighting device and a lighting fixture according to a first embodiment will be described in detail below with reference to the accompanying drawings.

Figure 1:
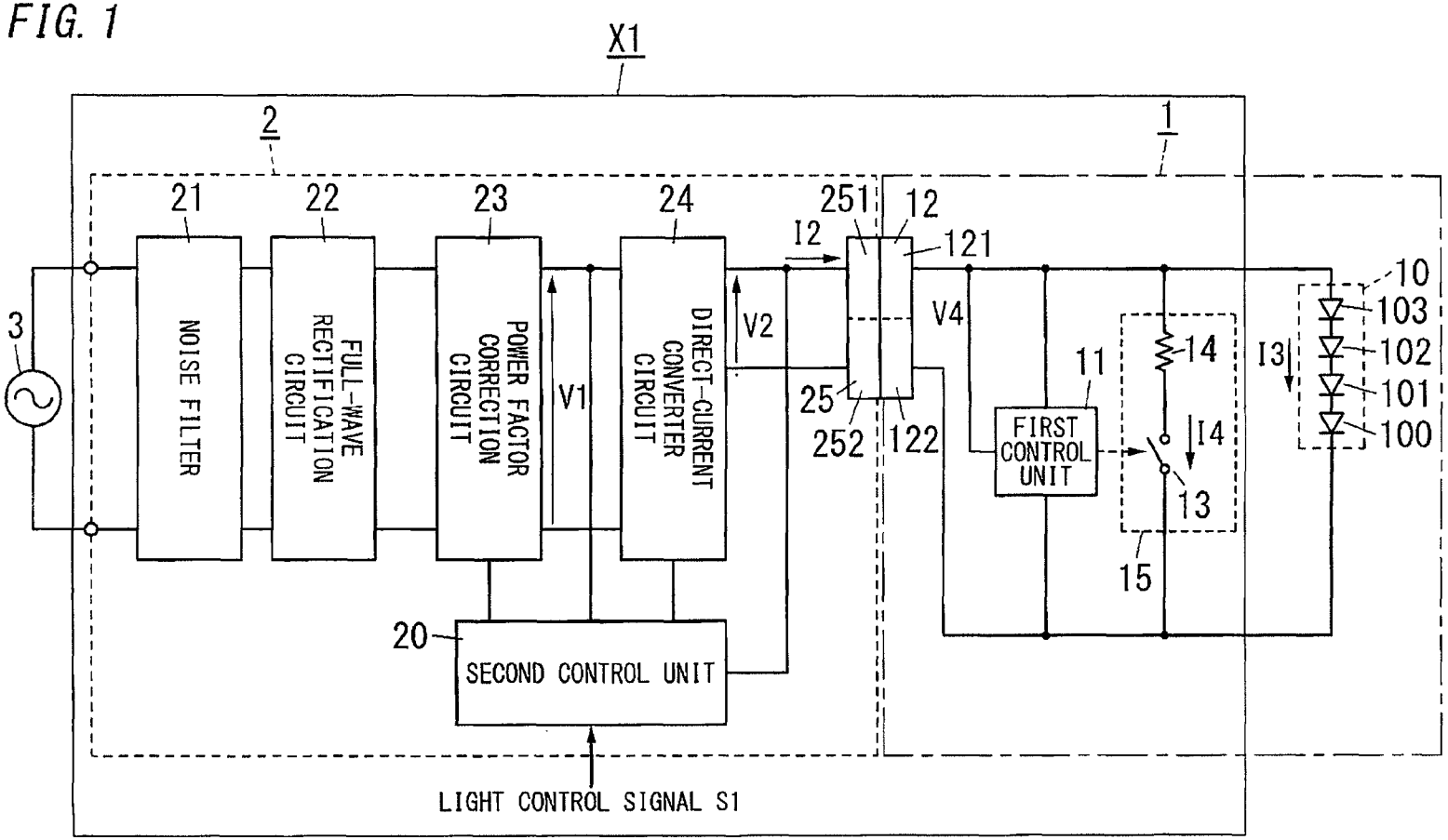
FIG. 1 is a circuit configuration diagram illustrating a lighting device according to a first embodiment.

A lighting device X1 according to this embodiment includes a light source unit 1 and a power supply unit 2, as illustrated in FIG. 1.

The light source unit 1 includes a light source 10 and a circuit unit. The light source 10 is formed of a series circuit of a plurality of (four in this case) light emitting diodes 100 to 103, which are solid light emitting diodes. Also, the circuit unit includes a first connector 12, a first control unit 11, a switch element 13, a resistor 14, and the like. However, in the light source unit 1, only the circuit unit is included in the lighting device X1 and the light source 10 is not included in the lighting device X1.

The first connector 12 is removably coupled to a second connector 25 of the power supply unit 2. A positive contact 121 and a negative contact 122 are provided in the first connector 12. A positive terminal (an anode of the light emitting diode 103) of the light source 10 is coupled to the positive contact 121. A negative terminal (a cathode of a light emitting diode 100) of the light source 10 is coupled to the negative contact 122. Also, the switch element 13 is coupled to the light source 10 with the resistor 14 in parallel.

Figure 2:
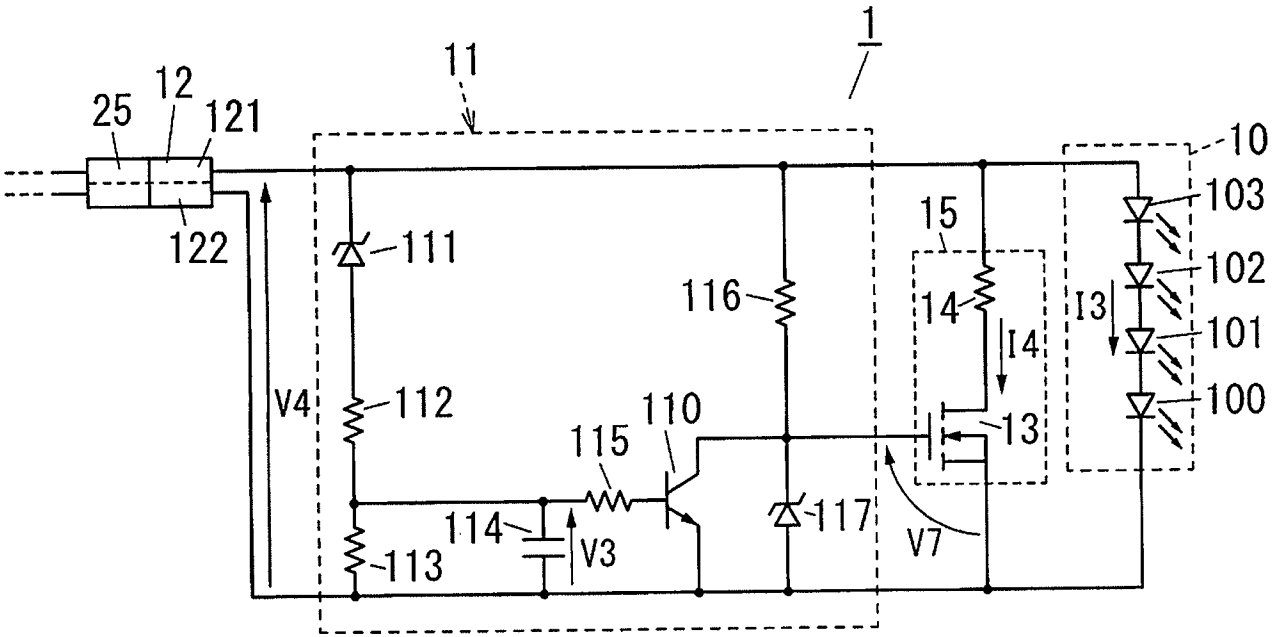
FIG. 2 is a circuit configuration diagram of a light source unit in the lighting device according to the first embodiment.

The first control unit 11 includes, as illustrated in FIG. 2, an NPN type bipolar transistor (which will be hereinafter abbreviated to a transistor) 110, four resistors 112, 113, 115, and 116, two zener diodes 111 and 117, a capacitor 114, and the like. Note that the switch element 13 is preferably formed of an n-channel field-effect transistor, as illustrated in FIG. 2.

The first zener diode 111 is configured such that the cathode thereof is coupled to the positive terminal (the positive contact 121) of the first connector 12 and the anode thereof is coupled to one end of a series circuit of the resistors 112 and 113. The other terminal of the series circuit of the resistors 112 and 113 is coupled to the negative terminal (the negative contact 122) of the first connector 12.

The second zener diode 117 is configured such that the cathode thereof is coupled to the gate of the switch element 13 and the anode thereof is coupled to the negative terminal (the negative contact 122) of the first connector 12. Also, the cathode of the second zener diode 117 is also coupled to the positive terminal (the positive contact 121) of the first connector 12 via the resistor 116.

The transistor 110 is configured such that the emitter thereof is coupled to the negative electrode (the negative contact 122) of the first connector 12 and the collector thereof is coupled to the cathode of the second zener diode 117 and the gate of the switch element 13. Also, the base of the transistor 110 is coupled to a connection point of the resistor 112 and the resistor 113 via the resistor 115. Furthermore, the capacitor 114 is coupled between the connection point of the resistor 112 and the resistor 113 and the negative terminal (the negative contact 122) of the first connector 12.

The transistor 110 is turned off when a both-end voltage V3 of the capacitor 114 that is charged by a voltage (which will be hereinafter referred to as an input voltage) V4 applied between the positive terminal (the positive contact 121) and the negative terminal (the negative contact 122) of the first connector 12 is lower than a threshold Vth2. The transistor 110 is turned on when the both-end voltage V3 is the threshold Vth2 or higher. The threshold Vth2 is equal to a voltage obtained by dividing a zener voltage Vth1 of the first zener diode 111 by the two resistors 112 and 113. Note that the capacitor 114 and the resistor 115 form an integration circuit and keeps the transistor 110 from chattering with noise components. That is, when the input voltage V4 (=the output voltage V2) is a threshold Vth1 or higher, the both-end voltage V3 of the capacitor 114 reaches a predetermined threshold (a drive voltage) Vth2 and the transistor 110 is turned on. On the other hand, when the input voltage V4 is lower than the threshold Vth1, the both-end voltage V3 of the capacitor 114 is lower than the threshold (the drive voltage) Vth2 and the transistor 110 is turned off (see FIG. 3).

When the transistor 110 is off, the second zener diode 117 is made conductive, so that a voltage is applied between the gate and source of the switch element 13, and therefore, the switch element 13 is turned on.

On the other hand, when the transistor 110 is on, the second zener diode 117 is not made conductive, so that a voltage is not applied between the gate and source of the switch element 13, and therefore, the switch element 13 is turned off.

That is, the first control unit 11 is configured to turn on, when the both-end voltage V3 is lower than the threshold Vth2, the switch element 13, and turns off, when the both-end voltage V3 is the threshold Vth2 or higher, the switch element 13.

In this case, when the switch element 13 is on, a current I4 flows in the switch element 13 and the resistor 14, and therefore, a current (which will be hereinafter referred to as a load current) I3 flowing in the light source 10 is relatively reduced (or is substantially zero). Also, when the switch element 13 is off, a current does not flow in the switch element 13 and the resistor 14, and therefore, the load current I3 is relatively increased.

The power supply unit 2 includes, as illustrated in FIG. 1, a second control unit 20, a noise filter 21, a full-wave rectification circuit 22, a power factor correction circuit 23, a direct-current converter circuit 24, a second connector 25, and the like.

The noise filter 21 is configured to remove harmonic wave noise included in an alternating-current voltage and an alternating current supplied from an alternating-current power source 3. The full-wave rectification circuit 22 is, for example, formed of a diode bridge and is configured to perform full-wave rectification of the alternating-current voltage and the alternating current input via the noise filter 21.

The power factor correction circuit 23 is formed of a well-known voltage boosting chopper circuit and is configured to boost a pulsating voltage output from the full-wave rectification circuit 22 to a desired direct-current voltage V1 and output it.

The direct-current converter circuit 24 is formed of a well-known voltage dropping chopper circuit and is configured to drop the direct-current voltage V1 output from the power factor correction circuit 23 to a predetermined direct-current voltage (which will be hereinafter referred to as an output voltage) V2 (<V1).

A positive contact 251 and a negative contact 252 are provided in the second connector 25. The positive contact 251 is coupled to a high potential side output terminal of the direct-current converter circuit 24. The negative contact 252 is coupled to a low potential side output terminal of the direct-current converter circuit 24.

The second control unit 20 is configured to control each of the power factor correction circuit 23 and the direct-current converter circuit 24 independently. In this regard, the second control unit 20 may be configured to include an integrated circuit that controls the power factor correction circuit 23, an integrated circuit that controls the direct-current converter circuit 24, and an integrated circuit that control the two integrated circuits.

The second control unit 20 is configured to perform feedback control of the power factor correction circuit 23 and thereby cause the direct-current voltage V1 to match a predetermined target value. Also, the second control unit 20 is configured to perform feedback control of the direct-current converter circuit 24 and thereby cause the output voltage V2 to match a predetermined value. Furthermore, the second control unit 20 is configured to cause the direct-current converter circuit 24 to intermittently operate in accordance with the light control level indicated by a light control signal S1 and thereby perform burst light control described in the related are technique.

Figure 3:
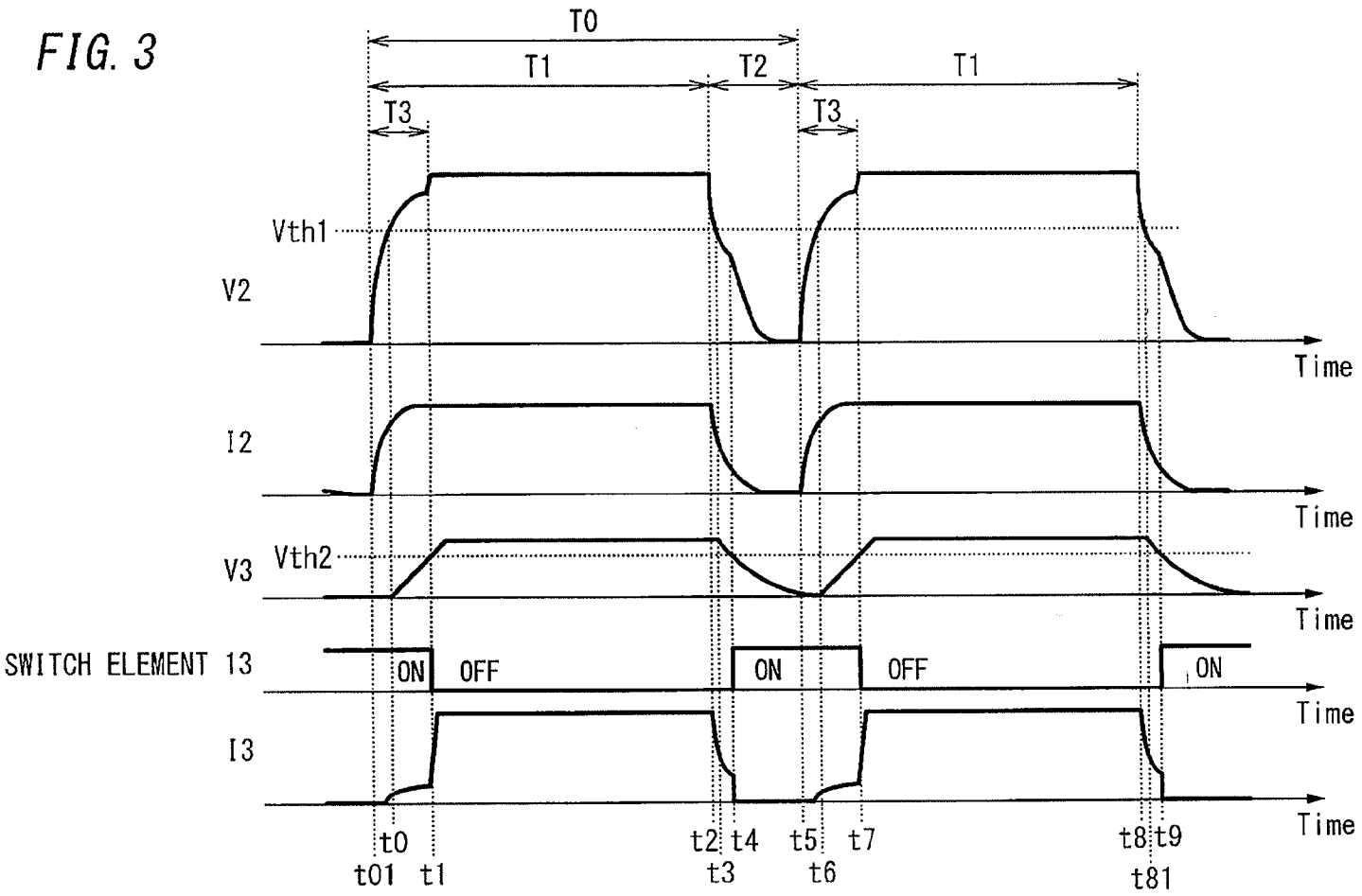
FIG. 3 is a time chart illustrating an operation of the lighting device according to the first embodiment.
Figure 4:
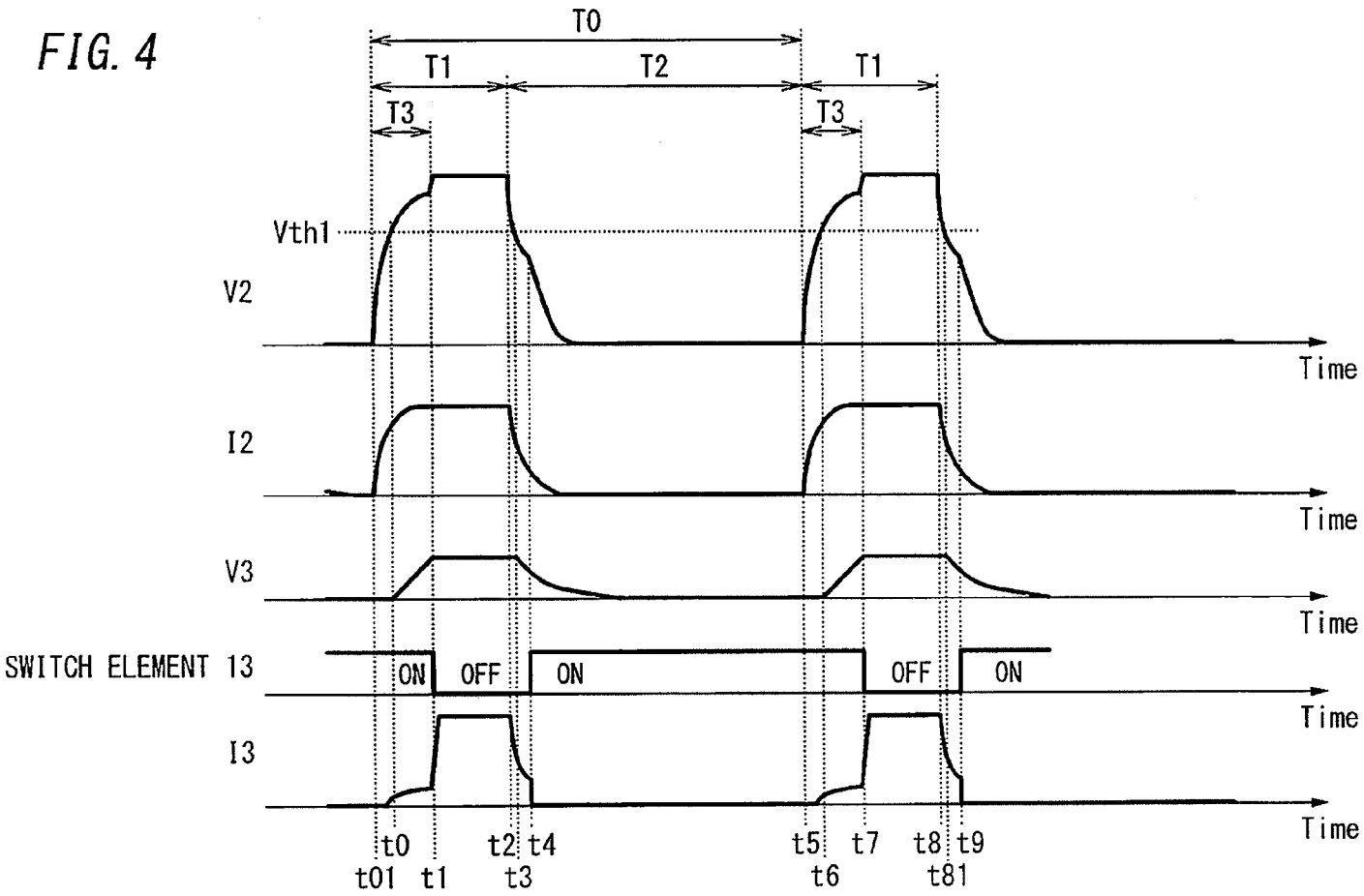
FIG. 4 is a time chart illustrating an operation of the lighting device according to the first embodiment.
Figure 5:
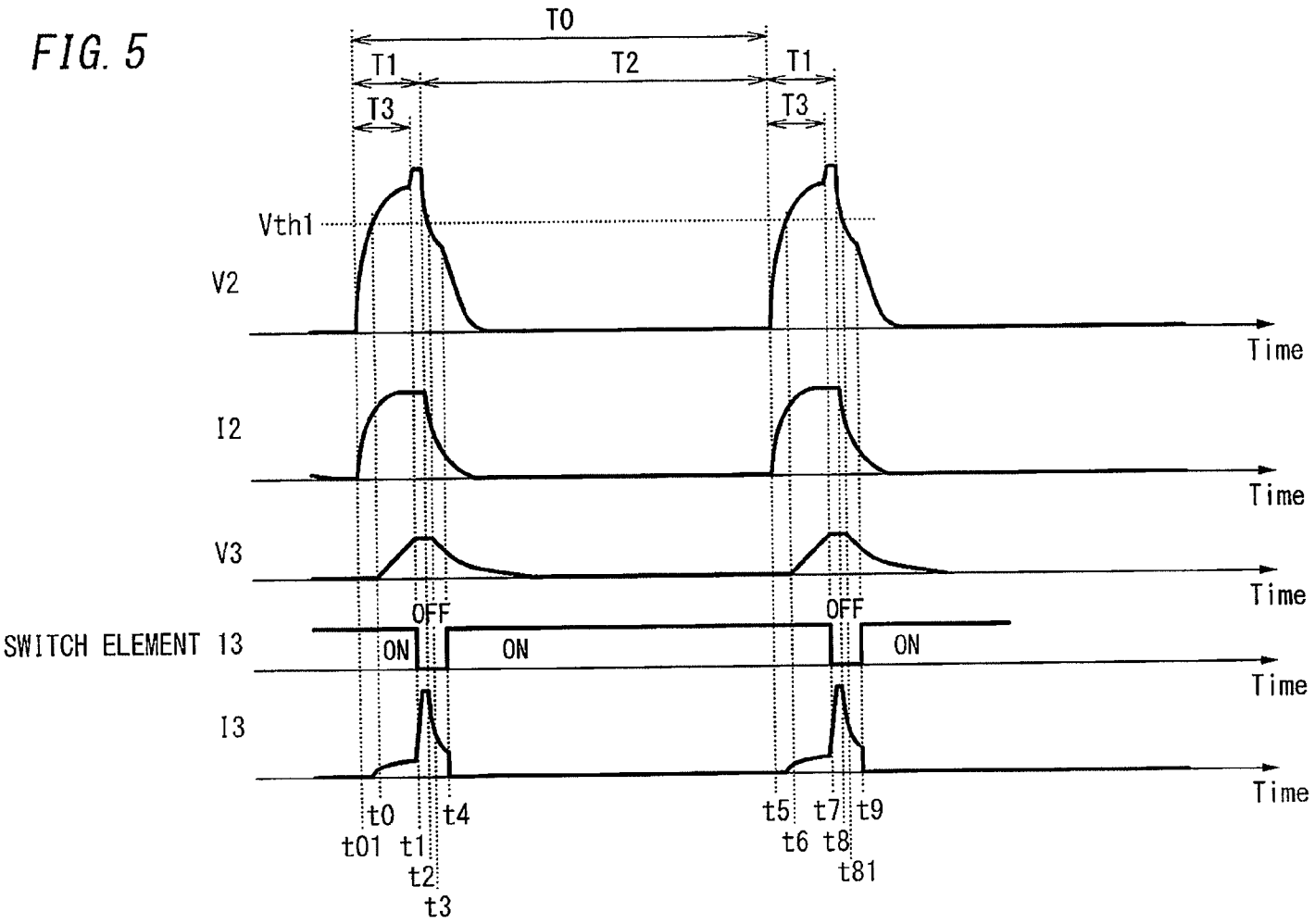
FIG. 5 is a time chart illustrating an operation of the lighting device according to the first embodiment.

Next, an operation of the lighting device X1 according to this embodiment will be described with reference to the time charts of FIG. 3 to FIG. 5. In this regard, the current I2 in FIG. 3 to FIG. 5 represents an output current of the power supply unit 2 (see FIG. 1). Also, FIG. 3 illustrates a case where the on-duty ratio in burst light control is about 80%, FIG. 4 illustrates a case where the on-duty ratio is about 30%, and FIG. 5 illustrates a case where the on-duty ratio is about 15%.

First, when an operation period T1 of burst light control is started (time t=t01), the output voltage V2 of the power supply unit 2 starts rising and the output current I2 of the power supply unit 2 also starts increasing. When the output voltage V2 of the power supply unit 2 reaches the zener voltage Vth1 at time t=t0 in the operation period T1 of burst light control, the first zener diode 111 is made conductive, so that charging of the capacitor 114 is started and the both-end voltage V3 of the capacitor 114 starts rising. In this regard, before this time point (time t=t0), the switch element 13 is on. Thus, most of the output current I2 of the power supply unit 2 flows in an impedance adjustment unit 15 including the resistor 14 and the switch element 13. Therefore, only a very small load current I3 flows in the light source 10.

At time t=t1, the both-end voltage V3 of the capacitor 114 reaches the drive voltage Vth2, and therefore, the transistor 110 is turned on and the switch element 13 is turned off. Thus, a current does not flow in the impedance adjustment unit 15 (the resistor 14 and the switch element 13) and the output current I2 of the power supply unit 2 flows only in the light source 10.

At time t=t2, the second control unit 20 ends an operation period T1 of burst light control, starts a halt period T2, and stops the direct-current converter circuit 24. When the direct-current converter circuit 24 is stopped, charging electric charges of a smoothing capacitor provided in an output stage of the direct-current converter circuit 24 are discharged, the output current I2 of the power supply unit 2 gradually reduces, and the output voltage V2 gradually lowers. Also, as the output current I2 of the power supply unit 2 reduces, the load current I3 flowing in the light source 10 gradually reduces.

After time t=t3, the output voltage V2 of the power supply unit 2 is lower than the zener voltage Vth1, and therefore, the both-end voltage V3 of the capacitor 114 starts reducing. Note that the speed at which the both-end voltage V3 reduces is determined by a time constant determined by the electrostatic capacity of the capacitor 114 and the resistance value of the resistor 115.

Then, at time t=t4, the both-end voltage V3 of the capacitor 114 is lower than the drive voltage Vth2, and therefore, the transistor 110 is turned off and the switch element 13 is turned on. Therefore, a current starts flowing in the impedance adjustment unit 15 (the resistor 14 and the switch element 13) and the load current I3 hardly flows in the light source 10.

Then, at time t=t5, the second control unit 20 starts an operation period T1 of burst light control and causes the direct-current converter circuit 24 to operate. When the direct-current converter circuit 24 starts operating, the output voltage V2 of the power supply unit 2 rises. Then, when the output voltage V2 of the power supply unit 2 reaches the zener voltage Vth1 at time t=t6, the zener diode 111 is made conductive, charging of the capacitor 114 is started, and the both-end voltage V3 of the capacitor 114 starts rising. Thereafter, the operation during time t=t1 to t5 is repeated (time t=t6 to t9), so that the lighting device X1 performs light control lighting of the light source 10 at the light control level corresponding to each on-duty ratio.

Then, as illustrated in FIG. 3 to FIG. 5, as the on-duty ratio reduces, the period (for example, a period of time t=t0 to t4) in which the load current I3 flows in the light source 10 reduces. Furthermore, during the period in which the load current I3 flows, in an adjustment period T3 (for example, time t=t0 to t1) in which the switch element 13 is on, most of the output current I2 of the power supply unit 2 flows in the impedance adjustment unit 15, and thus, the load current I3 reduces. That is, as compared to a case where the impedance adjustment unit 15 (the resistor 14 and the switch element 13) is not coupled to the light source 10 in parallel, the total amount (an integral value) of the load current I3 flowing in the light source 10 in the operation period T1 relatively reduces.

For example, assume that the rated voltage of the light source 10 is about 45 volts, the peak value of the load current I3 is about 1 ampere, and the peak value of a current flowing in the impedance adjustment unit 15 is about 0.9 amperes. In this case, when the on-duty ratio is 15%, power consumed in the resistor 14 of the impedance adjustment unit 15 is about 6 watts (≅45 volts×0.9 amperes×0.15). Therefore, total power supplied to the light source 10 from the lighting device X1 in the operation period T1 is 6.75 watts (=45 volts×1 ampere×0.15), and therefore, power supplied to the light source 10 is about 0.75 watts. That is, when the on-duty ratio is 15%, the ratio of power to supply power (45 volts×1 ampere=45 watts) at the time of rated lighting (when the on-duty ratio is 100%) greatly reduces from 6.75/45=0.15 to 0.75/45≅0.02. As a result, in the lighting device X1 according to this embodiment, light control to a low light control level is enabled while reducing flickers of the light source 10 by reducing power supplied to the light source 10 without reducing the operation period T1 of the direct-current converter circuit 24. Note that the resistor 14 is preferably mounted on a heat radiating substrate with the light emitting diodes 100 to 103 of the light source 10.

As described above, the lighting device X1 according to this embodiment includes the power conversion unit (the direct-current converter circuit 24), the impedance adjustment unit 15, the first control unit 11, and the second control unit 20. The power conversion unit (the direct-current converter circuit 24) is configured to convert input power to direct-current power used for the light source 10 including solid light emitting elements (the light emitting diodes 100 to 103). The impedance adjustment unit 15 is formed of a series circuit of the resistor (resistance element) 14 and the switch element 13 and is coupled to the light source 10 in parallel, relative to the power conversion unit (the direct-current converter circuit 24). The second control unit 20 is configured to cause the power conversion unit (the direct-current converter circuit 24) to operate for the operation period T1, which is not loner than the burst cycle T0, for each predetermined burst cycle T0 and increase and reduce the ratio (the duty ratio) of the operation period T1 to the burst cycle T0. The first control unit 11 is configured to make the switch element 13 conductive for a predetermined adjustment period T3 (time t=t01 to t1), which is not longer than the operation period T1, during the operation period T1.

The lighting device X1 according to this embodiment is configured in the above-described manner, bypasses a current through the impedance adjustment unit 15 (the resistor 14 and the switch element 13) for the adjustment period T3, and thus, the light control level may be reduced without reducing the operation period of the power conversion unit. Thus, cases where the operation period of the power conversion unit is relatively short, that is, cases where a fluctuation in light quantity is easily recognized by humans may be reduced. As a result, the lighting device X1 according to this embodiment is enabled to perform light control to the light control level while reducing flickers of the light source 10.

In other words, the lighting device X1 according to this embodiment advantageously enables light control to a low light control level while reducing flickers, by reducing power supplied to the light source 10 without reducing the operation period of the power conversion unit.

In the lighting device X1 according to this embodiment, the first control unit 11 preferably starts the adjustment period T3 in synchronization with a timing (time t=t01 or t5) with which the operation period T1 is started. As another option, the lighting device X1 according to this embodiment is preferably configured to end the adjustment period T3 in synchronization with a timing (time t=t2 or t8) with which the operation period T1 is ended.

Furthermore, in the lighting device X1 according to this embodiment, the first control unit 11 is preferably configured to reduce the adjustment period T3 as the ratio of the operation period T1 increases, and increase the adjustment period T3 as the ratio of the operation period T1 reduces.

In this case, when, after the operation period T1 ends, the speed at which the both-end voltage V3 is reduced is reduced, a period in which the switch element 13 is on is relatively reduced, power consumed by the resistor 14 may be reduced for each burst cycle T0. Note that the speed at which the both-end voltage V3 is reduced reduces as the resistance value of the resistor 115 increases.

Second Embodiment

A lighting device X1 according to this embodiment is characterized by a configuration of a first control unit 11 of a light source unit 1 and configurations of the other components are in common with those of the first embodiment. Therefore, each component which is in common with the corresponding component of the first embodiment is denoted by the same reference character, and therefore the illustration and description thereof will be omitted, as appropriate.

Figure 6:
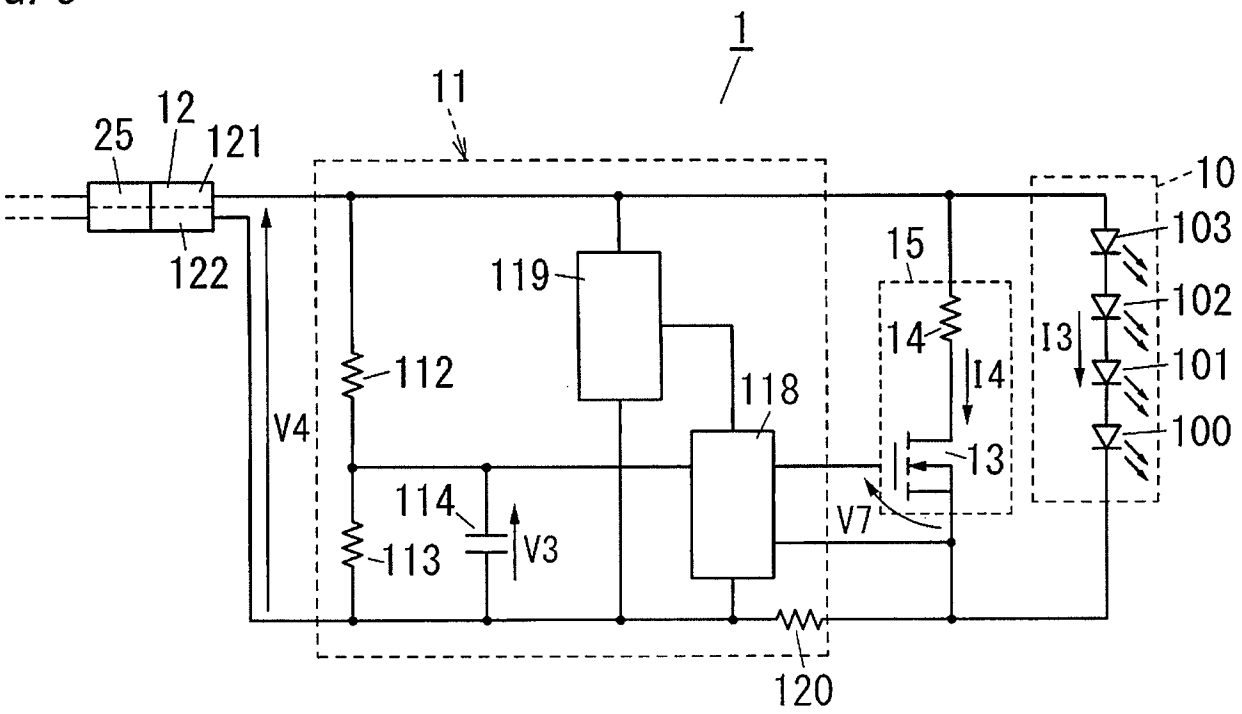
FIG. 6 is a circuit configuration diagram of a light source unit in a lighting device according to a second embodiment.

In the light source unit 1 according to this embodiment, the first control unit 11 includes, as illustrated in FIG. 6, a micro-processing unit (MPU) 118, a control power supply circuit 119, resistors 112, 113, and 120, a capacitor 114, and the like. In this regard, a component which is the same as the first control unit 11 in the first embodiment is denoted by the same reference character.

The control power supply circuit 119 includes a constant voltage regulator IC as a main component and is configured to generate a predetermined constant voltage as an operation power source of the MPU 118.

The MPU 118 is configured to execute a program stored in an internal memory, and control a switch element 13. Note that the resistor 120 is inserted between a negative terminal (the cathode of a light emitting diode 100) of a light source 10 and a negative terminal (a negative contact 122) of a first connector 12. The MPU 118 is configured to detect (the magnitude of) an output current I2 of the power supply unit 2 on the basis of a both-end voltage of the resistor 120.

Figure 7:
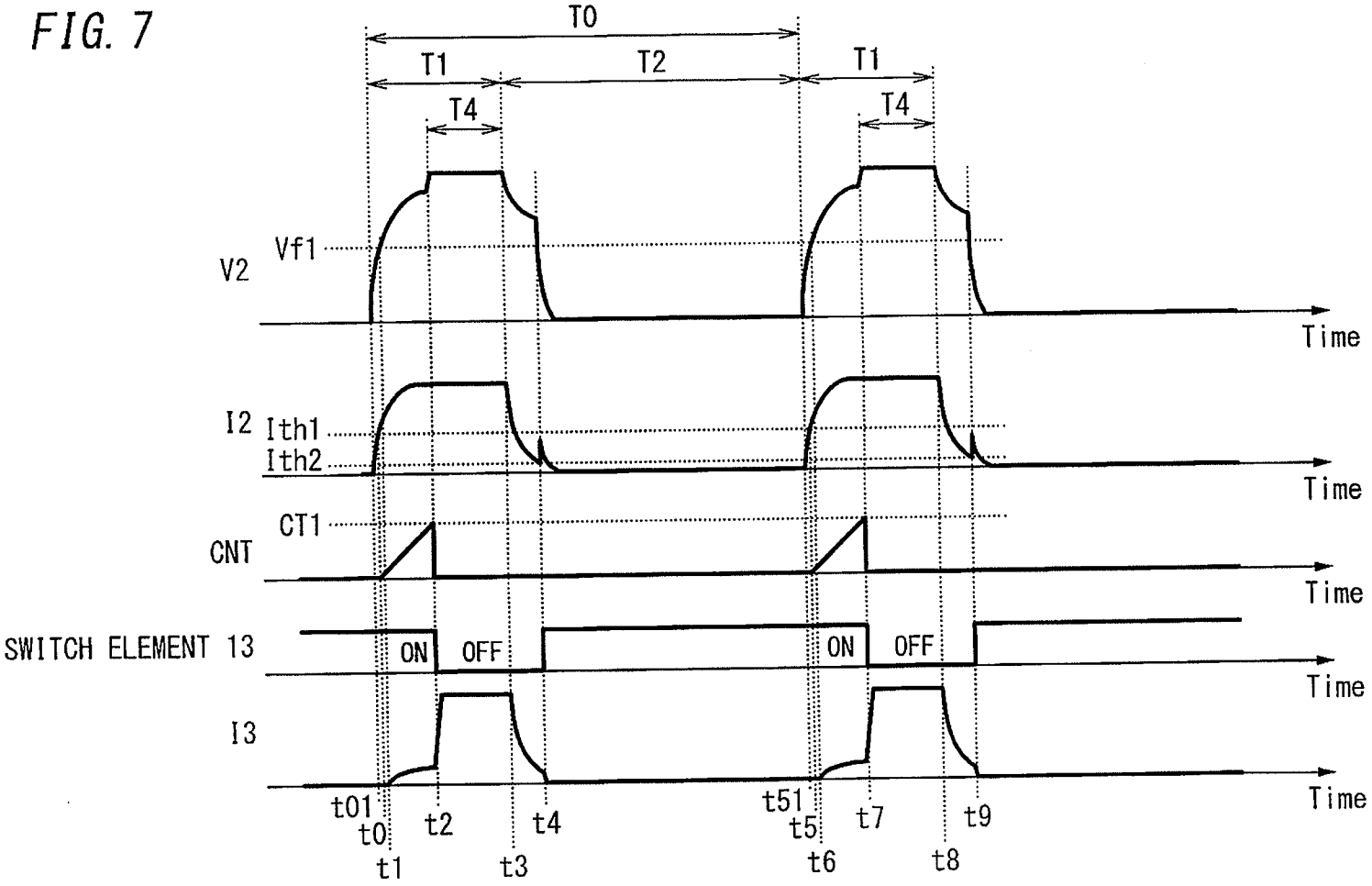
FIG. 7 is a time chart illustrating an operation of the lighting device according to the second embodiment.
Figure 8:
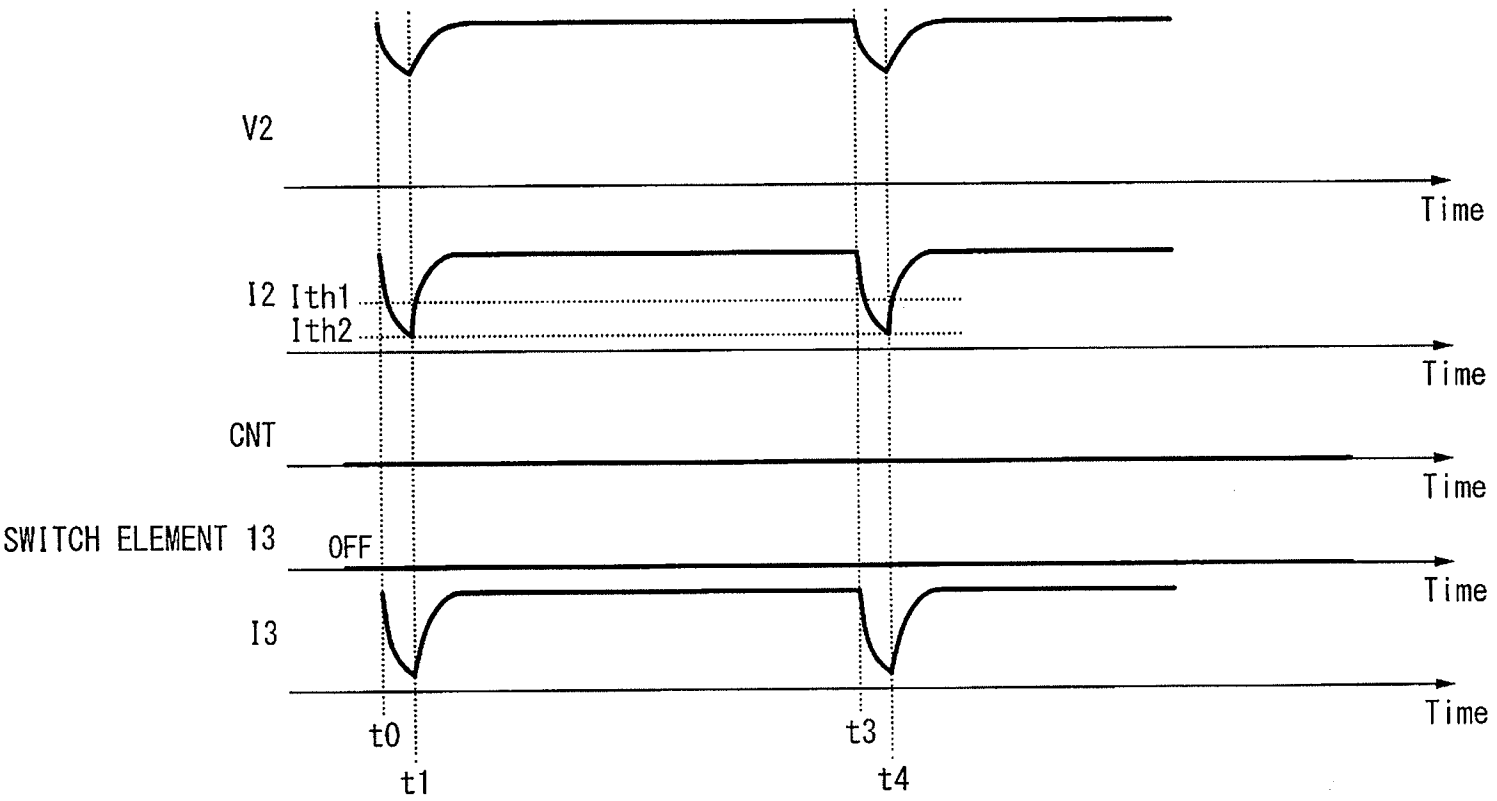
FIG. 8 is a time chart illustrating an operation of the lighting device according to the second embodiment.

Next, an operation of the lighting device X1 according to this embodiment will be described with reference to the time charts of FIG. 7 and FIG. 8. In FIG. 7 and FIG. 8, CNT denotes the count value of a timer counter provided in the MPU 118. Also, FIG. 7 illustrates a case where the on-duty ratio in burst light control is about 30% and FIG. 8 illustrates a case where the on-duty ratio is about 80%.

First, when an operation period T1 of burst light control is started (time t=t01), the output voltage V2 of the power supply unit 2 starts rising and an output current I2 of the power supply unit 2 also starts increasing. At this time, the switch element 13 is already on, and therefore, most of the output current I2 flows in an impedance adjustment unit 15 including a resistor 14 and the switch element 13 and a load current I3 is substantially zero.

Then, when the output current I2 reaches a first predetermined value Ith1 (time t=t0), the MPU 118 starts a count of the timer counter and causes the count value CNT to linearly increase.

At time t=t1, the output voltage V2 of the power supply unit 2 reaches a predetermined voltage Vf1 and the load current I3 starts flowing in the light source 10.

When the count value CNT of the timer counter reaches an upper limit value CT1 (time t=t2), the MPU 118 turns off the switch element 13. At the same time, the MPU 118 resets the count value CNT of the timer counter to zero. The switch element 13 is turned off, so that a current does not flow in the impedance adjustment unit 15 (the resistor 14 and the switch element 13) and the output current I2 of the power supply unit 2 flows only in the light source 10.

At time t=t3, the second control unit 20 ends an operation period T1 of bust light control, starts a halt period T2, and stops the direct-current converter circuit 24. When the direct-current converter circuit 24 stops, charging electric charges of a smoothing capacitor provided in an output stage of the direct-current converter circuit 24 are discharged, the output current I2 of the power supply unit 2 gradually reduces, and the output voltage V2 gradually lowers. As the output current I2 of the power supply unit 2 reduces, the load current I3 flowing in the light source 10 gradually reduces.

When the output current I2 reduces to a second predetermined value Ith2 (time t=t4), the MPU 118 turns on the switch element 13. Thus, a current starts flowing in the impedance adjustment unit 15 (the resistor 14 and the switch element 13) and the load current I3 is substantially zero.

Then, at time t=t5, the second control unit 20 starts an operation period T1 of burst light control and causes the direct-current converter circuit 24 to operate. When the direct-current converter circuit 24 starts operating, the output voltage V2 of the power supply unit 2 rises and the output current I2 increases. Then, when the output voltage V2 of the power supply unit 2 reaches the predetermined voltage Vf1 at time t=t6, the load current I3 starts flowing in the light source 10. Thereafter, the operation during time t=t1 to t4 is repeated (time t=t6 to t9), so that the lighting device X1 performs light control lighting of the light source 10 at the light control level corresponding to each on-duty ratio.

In this regard, when the on-duty ratio is relatively high, even in the halt period T2, the output current I2 of the power supply unit 2 does not reduce to the second predetermined value Ith2, the MPU 118 does not turn on the switch element 13 and maintains the switch element 13 in an off state. Therefore, power consumed in the resistor 14 of the impedance adjustment unit 15 is zero.

Then, the direct-current converter circuit 24 of the power supply unit 2 is controlled by the second control unit 20 such that the output current I2 is constant. On the other hand, the output voltage V2 of the direct-current converter circuit 24 fluctuates due to a voltage fluctuation of the light source 10, a variation in resistance value of the resistor 14, and the like.

Therefore, in the first embodiment, the first control unit 11 controls the switch element 13 on the basis of the level of the output voltage V2, and thus, setting of the threshold value Vth2 is difficult, so that timing with which the switch element 13 is turned on and off tends to vary.

In contrast to this, in this embodiment, the MPU 118 detects the output current I2, determines the operation period T1 of the power supply unit 2, and controls the switch element 13, so that an on period of the switch element 13 is advantageously stabilized, as compared to the first embodiment.

Incidentally, the MPU 118 may detect a period (a lighting period) T4 in which the light source 10 is lighted from a timing (time t=t2 or t7) with which the count value CNT of the timer counter reaches the upper limit CT1 and a timing (time t=t4 or t9) with which the switch element 13 is turned on. Therefore, if, when the light control level is relatively low (the on-duty ratio is relatively small), the MPU 118 adjusts the upper limit value CT1 to adjust the timing (time t=t2 or t7) with which the switch element 13 is turned off, efficiency in power conversion of the power supply unit 2 may be increased.

Third Embodiment

A lighting device X1 according to this embodiment is characterized in operations of a first control unit 11 of a light source unit 1 and a second control unit 20 of a power supply unit 2, and configurations of the light source unit 1 and the power supply unit 2 are in common with those of the second embodiment. Therefore, each component which is in common with the corresponding component the second embodiment is denoted by the same reference character and the illustration and description thereof will be omitted.

In the lighting device X1 of this embodiment, the first control unit 11 is preferably configured to make a switch element 13 conductive for a predetermined second operation period corresponding to properties of a light source 10 at start-up of a power conversion unit (a direct-current converter circuit 24). Then, a second control unit 20 is preferably configured to measure the second operation period from an output of a power conversion unit (the direct-current converter circuit 24) at start-up of the power conversion unit (the direct-current converter circuit 24). Furthermore, the second control unit 20 is preferably configured to adjust an output of the power conversion unit (the direct-current converter circuit 24) in accordance with a measurement value of the second operation period.

Figure 9:
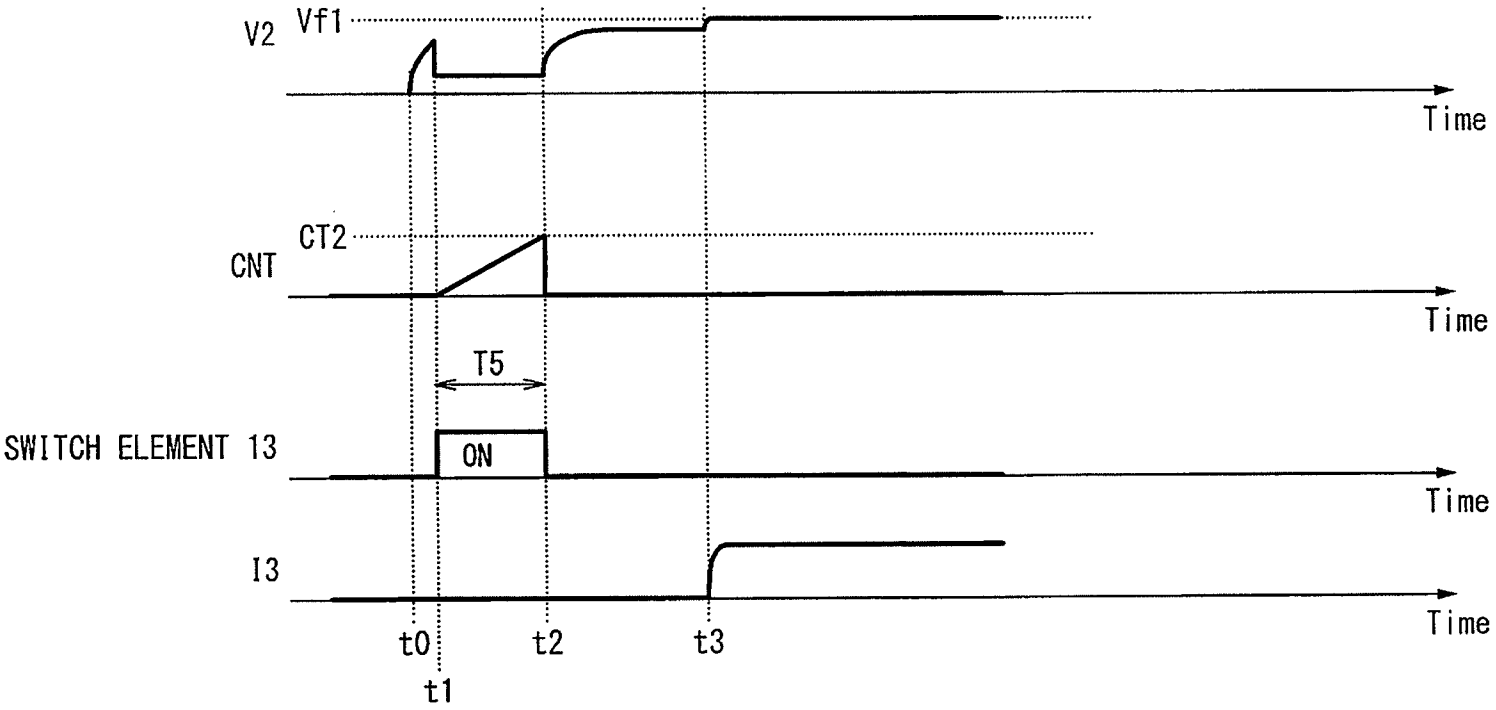
FIG. 9 is a time chart illustrating an operation of the lighting device according to a third embodiment.

Next, an operation of the lighting device X1 according to this embodiment, which characterizes the lighting device X1, will be described with reference to the time chart of FIG. 9.

When power is supplied from an alternating-current power source 3 to the lighting device X1 at time t=t0, charging to a smoothing capacitor of a power factor correction circuit 23 and a smoothing capacitor of the direct-current converter circuit 24 is started. Then, the output voltage V2 of the power supply unit 2 starts rising from time t=t0 and, when the output voltage V2 reaches a voltage at which a control power supply circuit 119 of the first control unit 11 is enabled to supply a control power supply voltage (time t=t1), an MPU 118 starts up. Immediately after the MPU 118 starts up, the MPU 118 starts a count of the timer counter and turns on the switch element 13. When the switch element 13 is turned on and a current flows in a resistor 14, an output current I2 increases to be greater than that before the switch element 13 is turned on, and therefore, the output voltage V2 of the power supply unit 2 reduces. In this regard, the control power supply circuit 119 includes an electrolytic capacitor, and therefore, even when the output voltage V2 reduces, the control power supply circuit 119 may maintain the control power supply voltage and kept the MPU 118 continuously operating.

The second control unit 20 of the power supply unit 2 monitors the output voltage V2 at all times and determines, on the basis of reduction in the output voltage V2 at time t=t1, that the switch element 13 of the light source unit 1 was turned on.

When the count value CNT of the timer counter reaches an initial upper limit value CT2 (time t=t2), the MPU 118 turns off the switch element 13. At the same time, the MPU 118 resets the count value CNT of the timer counter to zero. The switch element 13 is turned off, and thus, a current does not flow in an impedance adjustment unit 15 (the resistor 14 and the switch element 13), so that the output voltage V2 of the power supply unit 2 rises.

On the basis of rise of the output voltage V2, the second control unit 20 of the power supply unit 2 determines that the switch element 13 of the light source unit 1 was turned off.

Then, the MPU 118 of the first control unit 11 preferably stores the upper limit value CT2 corresponding to properties (for example, a rated voltage, a rated current, and the like) of the light source 10 in an internal memory.

The second control unit 20 of the power supply unit 2 may measure a second operation period T5 (time t=t1 to t2) in which the switch element 13 is on at start-up and know properties of the light source 10 of the light source unit 1. Then, the second control unit 20 preferably adjusts an output (the output current I2) of the direct-current converter circuit 24 in accordance with the properties of the light source 10.

The lighting device X1 according to this embodiment is configured in the above-described manner, and therefore, may correspond to a plurality types of light sources 10 having different properties.

Fourth Embodiment

Figure 10:
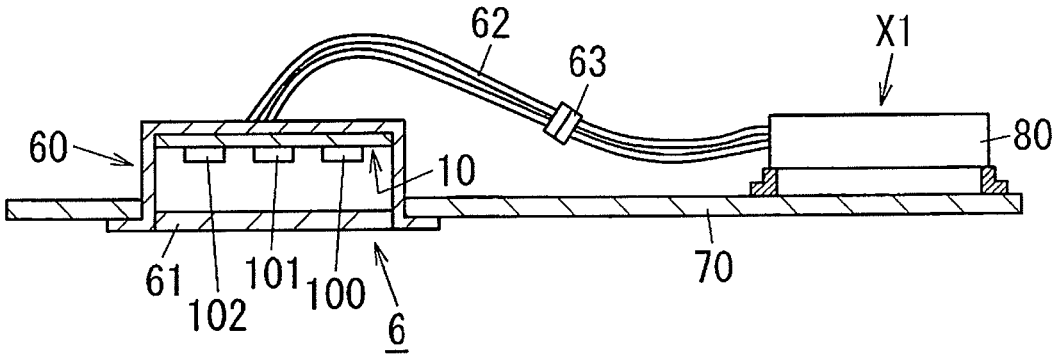
FIG. 10 is a cross-sectional view illustrating a lighting fixture according to a fourth embodiment.

A lighting fixture according to a fourth embodiment is illustrated in FIG. 10.

A lighting fixture 6 according to this embodiment is a ceiling flush type downlight that is to be provided in a ceiling 70, and includes a fixture body 60 in which a light source 10 is incorporated and a lighting device X1 provided on a back side (an upper side) of the ceiling 70.

The fixture body 60 is formed from a metal material such as aluminum die-casting so as to have a bottomed cylindrical shape with a lower surface open. Light emitting diodes 100 to 103 are attached to an internal bottom surface of the fixture body 60 (in this regard, only the light emitting diodes 100 to 102 are illustrated in FIG. 10). Also, an opening in the lower surface of the fixture body 60 is closed by a disk shaped cover 61. Note that the cover 61 is made of a transparent material, such as glass, polycarbonate, and the like.

The lighting device X1 according to this embodiment may be any one of the lighting devices X1 of the first to third embodiments, and is stored in a metal case 80 formed so as to have a rectangular box shape. Also, the lighting device X1 is coupled to the light source 10 of the fixture body 60 via a power cable 62 and a connector 63.

The lighting fixture 6 according to this embodiment may advantageously enables light control to a low light control level while reducing flickers by reducing power supplied to the light source 10 without reducing an operation period of a power conversion unit.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device, comprising:

a power conversion unit;

an impedance adjustment unit;

a first control unit; and a second control unit, wherein the power conversion unit is configured to convert input power to direct-current power used for a light source formed of a solid light emitting element, the impedance adjustment unit is formed of a series circuit of a resistor element and a switch element and is coupled to the light source in parallel, relative to the power conversion unit, the second control unit is configured to cause the power conversion unit to operate, for each predetermined burst cycle, for an operation period which is not longer than the burst cycle, and increase and reduce a ratio of the operation period to the burst cycle, and the first control unit is configured to make the switch element conductive for a predetermined adjustment period which is not longer than the operation period, during the operation period.

2. The lighting device according to claim 1, wherein the first control unit is configured to start the adjustment period in synchronization with a timing with which the operation period is started, or end the adjustment period in synchronization with a timing with which the operation period is ended.

3. The lighting device according to claim 1, wherein the first control unit is configured to make the switch element conductive for a predetermined second operation period corresponding to a property of the light source at start-up of the power conversion unit, and the second control unit is configured to measure the second operation period from an output of the power conversion unit at start-up of the power conversion unit, and adjust the output of the power conversion unit in accordance with a measurement value of the second operation period.

4. The lighting device according to claim 1, wherein the first control unit is configured to reduce the adjustment period as the ratio of the operation period increases, and increase the adjustment time as the ratio of the operation period reduces.

5. The lighting device according to claim 2, wherein the first control unit is configured to make the switch element conductive for a predetermined second operation period corresponding to a property of the light source at start-up of the power conversion unit, and the second control unit is configured to measure the second operation period from an output of the power conversion unit at start-up of the power conversion unit, and adjust the output of the power conversion unit in accordance with a measurement value of the second operation period.

6. The lighting device according to claim 2, wherein the first control unit is configured to reduce the adjustment period as the ratio of the operation period increases, and increase the adjustment time as the ratio of the operation period reduces.

7. The lighting device according to claim 3, wherein the first control unit is configured to reduce the adjustment period as the ratio of the operation period increases, and increase the adjustment time as the ratio of the operation period reduces.

8. The lighting device according to claim 5, wherein the first control unit is configured to reduce the adjustment period as the ratio of the operation period increases, and increase the adjustment time as the ratio of the operation period reduces.

9. A lighting fixture, comprising:

the lighting device according to claim 1; and a fixture body in which the light source is incorporated.

10. A lighting fixture, comprising:

the lighting device according to claim 2; and a fixture body in which the light source is incorporated.

11. A lighting fixture, comprising:

the lighting device according to claim 3; and a fixture body in which the light source is incorporated.

12. A lighting fixture, comprising:

the lighting device according to claim 4; and a fixture body in which the light source is incorporated.

13. A lighting fixture, comprising:

the lighting device according to claim 5; and a fixture body in which the light source is incorporated.

14. A lighting fixture, comprising:

the lighting device according to claim 6; and a fixture body in which the light source is incorporated.

15. A lighting fixture, comprising:

the lighting device according to claim 7; and a fixture body in which the light source is incorporated.

16. A lighting fixture, comprising:

the lighting device according to claim 8; and a fixture body in which the light source is incorporated.

* * * * *